United States Patent [19]

McNiel

[11] 4,378,475

[45] Mar. 29, 1983

[54] VELOCITY SENSITIVE IMPACT SWITCH

[76] Inventor: Frederick A. McNiel, 611 Boulden Ave., Austin, Tex. 78704

[21] Appl. No.: 354,108

[22] Filed: Mar. 2, 1982

[51] Int. Cl.[3] ..... H01H 35/14

[52] U.S. Cl. ..... 200/61.45 R; 200/61.45 M; 200/61.5

[58] Field of Search ..... 200/61.45 R, 61.45 M, 200/61.48, 61.53

[56] References Cited

U.S. PATENT DOCUMENTS

| | | | |
|---|---|---|---|
| 3,066,202 | 11/1962 | Kaleba et al. | 200/61.5 |
| 3,644,921 | 2/1972 | Duggan et al. | 200/61.52 X |
| 3,715,003 | 2/1973 | Jubenville | 200/61.45 M X |
| 3,784,773 | 1/1974 | Jubenville | 200/61.45 M |

FOREIGN PATENT DOCUMENTS

| | | | |
|---|---|---|---|
| 2273689 | 1/1976 | France | 200/61.5 |

*Primary Examiner*—J. R. Scott

*Attorney, Agent, or Firm*—Jones, Tullar & Cooper

[57] ABSTRACT

An impact switch sensitive to horizontally directed forces and to inversion of the switch is disclosed. The switch includes a U-shaped ball chase in which is mounted a movable actuating mass such as a steel ball. A permanent magnet located at the bottom of the ball chase defines a ball seat. An upper ball chase wall above the ball seat limits vertical motion of the ball to restrict switch actuation to horizontal impact forces. Switch actuators operating a common switch are located at the top ends of the U-shaped ball chase, whereby impact forces which move the ball off the ball seat will, if sufficiently large, cause the ball to run up one of the ball chase legs to strike one or the other of the switch actuators.

5 Claims, 4 Drawing Figures

FIG. 1
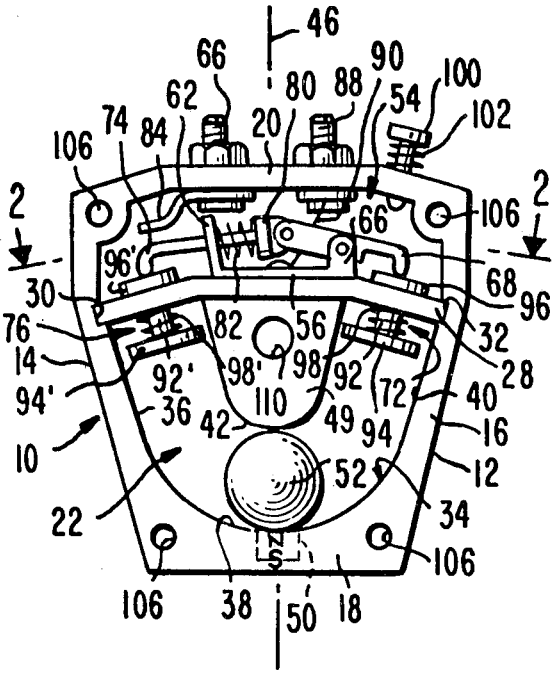
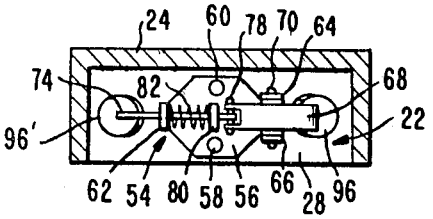
FIG. 2
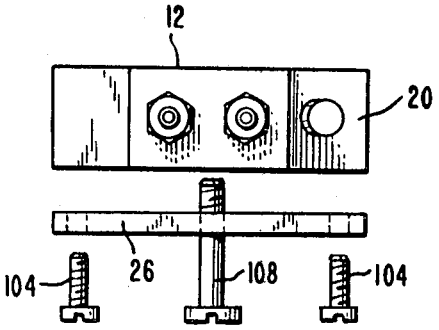
FIG. 3
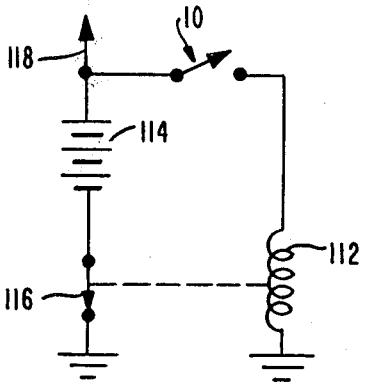
FIG. 4

VELOCITY SENSITIVE IMPACT SWITCH

BACKGROUND OF THE INVENTION

The present invention relates, in general, to impact switches, and more particularly to an impact switch which is sensitive only to horizontally directed forces of a predetermined magnitude and which is insensitive to vertical motion.

Impact switches of various designs and sensitive to predetermined forces are well known in the art and find use, for example, in safety devices for vehicles. Such switches may be used to actuate safety equipment such as passenger restraint inflatable air bags, or to disconnect the vehicle electrical system when the vehicle is involved in an accident. A variety of such impact-sensitive switches have been developed in the prior art, as exemplified by U.S. Pat. No. 3,720,426 to Johnston, U.S. Pat. No. 3,784,773 to Jubenville, and others.

One of the problems encountered with prior safety switches of the impact type is that many are overly sensitive to the normal jolts and bounces to which a vehicle may be subject, and thus may respond in a non-impact situation to activate the safety equipment. Such unintended actuation can be extremely dangerous, and accordingly it is important to provide an impact switch that will be activated only upon the occurrence of specific conditions. Since such switches profoundly affect the safety of a vehicle's occupants, it is extremely important that impact switches of this type be extremely reliable and that they have a very small response time so that when an emergency situation arises, the safety equipment is instantly activated. Further, since such switches are in wide use, it is equally important that they be easy to make and to install, and thus that they be of a simple, uncomplicated construction.

SUMMARY OF THE INVENTION

It is therefore, an object of the present invention to provide a reliable, fast-acting impact switch.

Another object of the invention is to provide an impact switch that is simple, yet is sensitive and fast acting.

A further object of the present invention is to provide an impact switch that is responsive only to impact forces of predetermined magnitude, and in particular to a switch that is responsive to horizontal forces and non-responsive to vertical forces when in its upright position, but which is also sensitive to vehicle upset in the absence of horizontal impact.

Another object of the present invention is to provide a fast-acting impact switch which is responsive to forces occurring when the switch is subjected to impacts having a horizontal component of predetermined magnitude as when the vehicle in which the switch is mounted is travelling in excess of a predetermined minimum velocity and strikes an object, and which is also responsive to vehicle upset.

Briefly, the present invention relates to an impact switch which comprises a housing containing a U-shaped ball chase in which is mounted a steel actuating ball or similar movable mass. A permanent magnet is located at the lower-most section of the ball chase to retain the ball in a seat under the lowest extremity of the top wall of the chase to prevent actuation of the switch by a vertical impact force.

A switch assembly plate carrying snap-action switching elements spans of the U-shaped ball chase and supports two switch actuators, one located in each leg of the ball chase. The snap switching elements are of the over-center type that is normally open but which, when actuated, snaps to a closed position and remains in that position until it is manually reset.

The impact switch is mounted in a vertical position within a vehicle to be protected, and when the vehicle is impacted with a predetermined minimum horizontal force component, the inertia of the steel actuating ball will cause the ball to move off the permanent magnet seat and to travel along one leg or the other of the U-shaped ball chase. If the impact is sufficiently great, as determined by the strength of the permanent magnet, the mass of the ball and length of the ball chase, the ball will strike one or the other of the switch actuators located at the upper ends of the ball chase. If the impact of the ball on the actuator is sufficiently great to overcome the bias of the snap switching elements, the switch will operate to activate a suitable safety feature, such as a solenoid-operated circuit braker which serves to disconnect the electrical system of the vehicle. Preferably the ball is of sufficient mass that if the vehicle should roll over the ball will be dislodged from its seat and fall onto one of the switch actuators with enough force to operate the switch.

The present switch is highly reliable since it is insensitive to vertical shock and will respond to horizontal impacts in excess of a predetermined minimum magnitude. Further, by using only a single set of switching elements mechanically operable by either of two actuators, the device is simplified, and by providing an over-center snap action which provides a positive electrical contact upon activation, the switch is made additionally reliable and rugged.

BRIEF DESCRIPTION OF THE DRAWINGS

The foregoing and additional objects, features and advantages of the present invention will become apparent to those of skill in the art from the following detailed description thereof, taken in conjunction with the accompanying drawings, in which:

FIG. 1 is a front elevation view of a switch in accordance with the present invention, with the housing cover removed;

FIG. 2 is a sectional view of the switch of FIG. 1, taken along lines 2—2 thereof;

FIG. 3 is an exploded top view of the switch of FIG. 1, showing the housing and its cover; and FIG. 4 is a simplified schematic diagram of an application of the switch of FIG. 1.

DESCRIPTION OF A PREFERRED EMBODIMENT

Turning now to a more detailed consideration of the present invention, there is illustrated at 10 in FIG. 1 a velocity sensitive impact switch constructed in accordance with the present invention. Switch 10 comprises a housing 12 which is generally rectangular in shape and which may be constructed of plastic or other suitable impact resistant, non-magnetic material. The housing includes side walls 14 and 16, a bottom wall 18, and a top wall 20 which cooperate to define an interior chamber 22. A back wall 24 and a removable front wall 26 cooperate with the top, bottom and side walls to enclose chamber 22.

The interior chamber is divided into upper and lower sections by a transversly mounted switch assembly plate which is secured in grooves 30 and 32 formed in walls 14 and 16, respectively. The interior surfaces of walls 14, 16 and 18 are curved and cooperate to form a generally parabolic lower channel surface 34. This channel surface 34 extends from a first upper leg portion 36 in the area of groove 30 downwardly in a smooth curve through a base portion 38 in lower wall 18 and upwardly to a second upper leg portion 40 terminating near the groove 32. In a preferred form of the invention, the upper leg portions 36 and 40 each form an angle of approximately 15 degrees from the vertical.

The upper surface of the guide channel is formed by a curved upper wall 42 which is the periphery of a generally triangular shoulder portion 44 that preferably is molded as a part of the back wall 24 of the housing. The upper surface 42 is generally parallel to the lower surface 34, these two curved surfaces defining therebetween the generally U-shaped guide channel, or ball chase 22.

Although the guide channel is described as being generally parabolic, it should be understood that it is not necessarily restricted to this shape; for example, the upper and lower channel surfaces may be semicircular and coaxial to each other. The guide channel is symmetrical about a central axis 46 of the switch, which axis is vertical for a proper operation of the switch.

A permanent magnet 50 is embedded in the bottom wall 18 of the housing, the magnet being located at the lower-most part of channel surface 34 to define a ball seat. The ball seat preferably is located on the central axis 46 of the switch and may include a small notch (not shown) to define the resting place for the movable switch actuating mass to be described. This ball seat is preferably aligned directly below the lower-most extremity of the curved upper surface 42, which also preferably lies on the vertical axis 46.

A steel ball 52 or other suitable switch actuating mass is located in the guide channel 22 and normally rests on the ball seat located at the bottom of the switch unit. The steel ball is held in that location by the permanent magnet 50, thereby holding the ball directly under the lowest extremity of the upper surface 42 of the guide channel. The ball is slightly smaller in diameter than the distance between channel walls 34 and 42 so that the ball is freely movable therein. However, the distance between walls 34 and 42 is such that when the ball 52 is at its rest position on the ball seat, vertical motion of the ball is limited by the proximity of the upper surface 34 so that a vertical impact on the switch will not inadvertently activate it. However, horizontal impact involving a force on the switch 10 having a component in a direction perpendicular to axis 46 and generally in the plane of the drawing will produce a horizontal force on ball 52 which will cause it to move either to the left or to the right (as viewed in FIG. 1), depending upon the direction of the impact force. The horizontal motion of the ball will be deflected in an upward direction by the curved lower channel surface 34 so that the ball will travel upwardly toward either the first upper leg portion 36 or the second upper leg portion 40.

The switch assembly plate 28 extends across and caps the upper ends of the leg portions 36 and 40 and, in addition, supports on its upper surface over-center snap action switching elements generally indicated at 54. The switching elements 54 include a switch frame 56 secured, for example, by rivets 58 and 60 (FIG. 2), to the upper surface of assembly plate 28. Switch frame 56 is of an electrically conductive material such as brass and carries at one end an upturned flange portion 62 which serves as a spring compression shoe, as will be described. At the opposite end of switch frame 56 is a pair of upstanding ears 64 and 66 which pivotally support a first switch arm 68 by means of a pivot pin 70.

One end of the switch arm 68 (the right-hand end as viewed in FIG. 1) is adapted to engage a switch actuator 72 mounted in the switch assembly plate 28, while the opposite end of arm 68 is bifurcated to provide a device which receives one end of a second switch arm 74, the opposite end of which is adapted to engage a second switch actuator 76, also mounted on the switch assembly plate 28. The switch arm 74 is pivotally connected to the bifurcated end of switch arm 68 by means of a pivot pin 78 (FIG. 2) and carries a spring retainer plate 80. Arm 74 passes through an aperture in the upturned compression shoe 62, and the portion arm 74 extending between shoe 62 and retainer 80 is surrounded by a coiled switch spring 82 which is held in compression between shoe 62 and spring retainer 80. This compression spring serves to bias the switch arms 68 and 74 into one or the other of two over-center positions so that the pivotal joint between the two arms is either above or below a straight line extending between pivot pin 70 and the aperture in compression shoe 62 through which arm 74 passes.

Switch arm 74 is a movable electrical contact and is adapted to move into and out of touch with a corresponding stationary electrical contact 84 which is mounted on the interior surface of top wall 20 by means of a first threaded terminal stud 86. A second threaded terminal stud 88 provides an electrical connection to switch arm 74 by way of a wire 90 connected between stud 88 and the electrically conductive switch frame 56. Wire 90 may be connected to switch frame 56 by means of a rivet 60, or other suitabe means.

As illustrated in FIG. 1, the switch is in its open position, with the outer ends of the switch arms 68 and 74 being in their down positions and being held in that position by the force of compressed spring 82. The switch can be moved to its closed position by either one of the actuators 72 or 76 moving upwardly to pivot a corresponding one of the arms 68 and 74. Pivoting of one arm causes the other arm also to pivot by reason of their connection at pin 78, and this causes arm 74 to be moved lengthwise through the aperture in shoe 62 against the compression force of spring 82. The two arms will be aligned with each other at dead center, and continued movement of one of the arms by its actuator will cause the arms to pass center, at which time spring 82 will snap the arms to their second stable, over-center position.

The actuators 72 and 76 are located in the upper leg portions 40 and 36, respectively, of the U-shaped channel 22 and consist of drive rods 92 and 92′, respectively, passing through corresponding apertures in the switch assembly plate 28, impact discs 94 and 94′ secured to the ends of the drive rods which extend into guide channel 22, and drive discs 96 and 96′ mounted on the upper ends of drive rods 92 and 92′ at the top surface of switch assembly plate 28. Surrounding the drive rods 92 and 92′ and compressed between switch assembly plate 28 and impact discs 94 and 94′ are coil springs 98 and 98′ which serve to bias the impact discs downwardly into channel 22 so that the switch is normally in the open position. An impact on either of discs 94 or 94′ of sufficient force to overcome the bias of springs 98 or 98′, respectively, will cause the switch arms 68 and 74 to shift over-center, against the pressure exerted by spring 82, to close arm 74 against stationary switch contact 84 and thereby close the switch.

A reset plunger 100 is mounted in the upper wall 20 of the housing and is biased toward its retracted position by means of a coil spring 102. The plunger passes through an aperture in the upper wall 20 and is adapted to move into engagement with the upper surface of switch arm 68, whereby the outer end of the arm may be pressed downwardly to shift the switch mechanism back to its open position.

The front cover 26 for the switch housing 20 may be secured to the housing by means of suitable screws 104 adapted to pass through corresponding apertures in the cover plate and to engage threaded apertures 106 in the housing. A mounting screw 108 passes through an aperture in cover plate 26 and through a corresponding aperture 110 in the housing 20 to permit the switch assembly 10 to be mounted to a suitable surface in the vehicle to be protected.

As illustrated in FIG. 4, one of the applications for impact switch 10 is as a safety device to open the electrical circuit of a vehicle in the event of an accident. This can be accomplished in the manner illustrated in FIG. 4 by connecting the switch 10 in series with a solenoid 112 across the battery 114 of the vehicle to be protected. Solenoid 112 is connected to a circuit breaker 114 which is normally closed to connect battery 114 to ground. However, upon occurrence of an impact sufficiently great to close switch 10, solenoid 112 is energized by the battery 114 to open circuit breaker switch 116, thereby disconnecting the battery from any electrical load connected to load line 118.

When the impact switch 10 is mounted in a vehicle which it is to protect, the switch is mounted with its axis 46 vertical so that during the course of normal travel of the vehicle, the unit will not be activated. The permanent magnet 50 holds the ball 52 in the center of channel 22 and under the lowest extremity of the upper surface 42 of the guide channel. In the event of a vertical impact on the switch, the ball will be held in place by shoulder 44 even if the impact is angled away from the vertical by a substantial amount, and the switch will remain open. However, upon the occurrence of a horizontal impact force of sufficient magnitude, which force may be angled away from the horizontal, but which has a horizontal vector of sufficient magnitude, the ball 52 will be driven out from under the shoulder 44 and will travel along channel 22 either to the left or to the right as viewed in FIG. 1. The impact force may be caused by the vehicle travelling in excess of a specified minimum velocity or, if the vehicle is stationary, by the vehicle being struck by an impact force. The horizontal forces imposed on the ball 52 disengage it from the magnetic field of permanent magnet 50 and cause the ball to travel along the lower surface 34 of channel 22, the curved surface transferring the initial straight line horizontal travel of the ball to an upwardly directed travel. If a sufficient impact force is applied, the ball will travel upwardly in the channel to strike either one of the switch actuators 72 or 74 to drive the actuator upwardly and to cause the switch mechanism to shift to its closed over-center position, where it will remain until it is reset. It will be understood that the force required to activate the switch assembly 54 will be determined by the weight of ball 52, the compression force of the springs 98 and 98', and the compression force of spring 82.

If the vehicle should be involved in an accident in which it overturns so that the switch is upside-down, without sufficient horizontal impact to activate the switch in the normal manner described above, in most instances the ball will be jarred loose from its magnetic seat and will drop onto one of the switch actuators with sufficient force to operate the switch. Thus, the switch is activated to provide protection both for impact and upset conditions.

Although the present invention has been described in terms of a preferred embodiment, it will be apparent to those of skill in the art that numerous of variations and modifications can be made without departing from the true spirit and scope of the invention as set forth in the following claims:

What is claimed is:

1. An impact switch responsive to horizontal impact forces exceeding a predetermined minimum value non-responsive to vertical impact forces, comprising:

a housing having an interior chamber;

a switch assembly plate mounted within and extending transversly across said chamber to form an upper chamber and a lower chamber;

a U-shaped guide channel formed within said lower chamber, said guide channel being defined by upwardly curved, spaced apart upper and lower surfaces, said U-shaped channel having first and second upper leg portions joined at a base portion;

movable switch actuating means in said guide channel, said switch actuating means normally being located in said base portion of said guide channel;

means for retaining said switch actuating means in said base portion;

a switch assembly mounted on said switch assembly plate and located in said upper chamber, said switch assembly including first and second switch arms pivotally interconnected to form an over-center, snap-action switch element movable between an open position and a closed position, said first switch arm comprising a movable electrical contact;

fixed electrical contact means mounted in said upper chamber and adapted to be contacted by said first switch arm when said snap-action switch element is shifted to its closed position;

first and second switch actuators mounted and extending through said switch assembly plate, said actuators extending into said first and second upper leg portions, respectively, each said actuator being adapted, upon impact of a predetermined magnitude by said movable switch actuating means on either one of said actuators, to pivot said first and second switch arms to shift said snap-action switch element to its closed position; and reset means for manually shifting said snap-action switch element to its open position, said movable switch actuating means being responsive to a horizontal impact force of predetermined minimum magnitude applied to said impact switch to move away from said base portion of said guide channel and along said curved lower surface thereof, upwardly into one of said upper leg portions to strike the corresponding switch actuator located therein with sufficient force to shift said snap-action switch element to thereby close said impact switch.

2. The impact switch of claim 1, wherein said movable switch actuating means is a steel ball.

3. The impact switch of claim 2, wherein said means for retaining said steel ball in said base portion of said guide channel comprises a ball seat.

4. The impact switch of claim 3, wherein said means for retaining said steel ball in said base portion further comprises a permanent magnet embedded in said housing adjacent said lower guide channel surface.

5. The impact switch of claim 1, further including first and second electrical terminal studs secured to said housing, said first stud being electrically connected to said fixed electrical contact means and said second stud being electrically connected to said first switch arm.

* * * * *